United States Patent [19]

Derimiggio

[11] Patent Number: 4,992,833

[45] Date of Patent: Feb. 12, 1991

[54] FIXING METHOD AND APPARATUS HAVING A TRANSFER-FIXING CHILLING DRUM

[75] Inventor: John E. Derimiggio, Fairport, N.Y.

[73] Assignee: Eastman Kodak Company, Rochester, N.Y.

[21] Appl. No.: 391,899

[22] Filed: Aug. 10, 1989

[51] Int. Cl.[5] ..... G03G 15/14; G03G 15/20

[52] U.S. Cl. ..... 355/282; 219/216; 355/271

[58] Field of Search ..... 355/279, 271, 272, 277, 355/282, 285, 290, 286; 219/216, 469, 470, 471

[56] References Cited

U.S. PATENT DOCUMENTS

| | | | |
|---|---|---|---|
| 2,990,278 | 6/1961 | Carlson | 355/286 X |
| 3,893,761 | 7/1975 | Buchan et al. | 355/272 |
| 3,923,392 | 12/1975 | Buchan et al. | 355/271 |
| 4,095,886 | 6/1978 | Koeleman et al. | 355/290 |
| 4,453,820 | 6/1984 | Suzuki | 355/279 |
| 4,542,978 | 9/1985 | Tarumi et al. | 355/279 |
| 4,659,927 | 4/1987 | Tago et al. | 219/216 X |
| 4,668,073 | 5/1987 | Hatabe et al. | 355/282 X |
| 4,684,784 | 8/1987 | Tamary | 355/290 X |
| 4,708,460 | 11/1987 | Langdon | 355/271 |
| 4,796,048 | 1/1989 | Bean | 355/277 |

FOREIGN PATENT DOCUMENTS

| | | | |
|---|---|---|---|
| 0164773 | 10/1982 | Japan | 355/290 |

*Primary Examiner*—A. T. Grimley
*Assistant Examiner*—William J. Royer
*Attorney, Agent, or Firm*—Tallam I. Nguti

[57] ABSTRACT

Fixing method and apparatus for producing high quality fixed images includes mechanisms for transferring unfused toner particles images from an image bearing member to a transparent intermediate fixing member, for fusing the transferred images to the intermediate fixing member by irradiation, for laminating a registerd receiver or copy sheet of paper to the intermediate fixing member over the fused images thereby sandwiching such fused images therebetween, and for chilling the laminate in order to effect transfer-fixing of fused images from the intermediate fixing member onto the receiver or copy sheet of paper.

2 Claims, 1 Drawing Sheet

FIXING METHOD AND APPARATUS HAVING A TRANSFER-FIXING CHILLING DRUM

BACKGROUND OF THE INVENTION

This invention relates to electrostatographic copiers and printers, and more particularly to a high quality and heat efficient method and apparatus therein for fixing images on a suitable receiver or copy sheet of paper without subjecting the receiver or copy sheet to high fusing temperatures and heat. The method and apparatus of the present invention thereby substantially prevent the occurrence of heat-related fusing and fixing defects such as curling, distortion, blistering and even charring of such a receiver or copy sheet.

Processes in electrostatographic copiers and printers for creating electrostatic latent images on an image-bearing member, developing such images with loose particles of toner, and then transferring the loose toner developed images to a suitable receiver or copy sheet of paper, are well known. In order to form a permanent copy of such images on the receiver or copy sheet, it is also well known to use heat for fusing and and/or pressure for fixing such loose particles of toner to the receiver or copy sheet. For such fusing and fixing, the loose toner particle images conventionally are transferred unfused to a heat absorbing receiver or copy sheet, and there fused by applying heat and pressure to the receiver or copy sheet.

In copiers or printers with roller fusing and fixing apparatus, the heat for fusing is supplied and applied by means of a heated roller, and in those with radiant fusing apparatus, the heat is supplied, for example, by an infrared heat source. In such conventional fusing and fixing apparatus, a substantial and extra amount of the heat generated by the heat source is unfortunately absorbed by the receiver or copy sheet. As a result, a lot more heat than is necessary to fuse such toner particles is detrimentally generated, and wasted by the apparatus. Additionally, because it takes time to produce such extra heat, conventional apparatus therefore take more time, than would otherwise be necessary, to heat fuse the loose toner images on such receiver or copy sheet.

Consequently, the quality of the fused images often is adversely affected, and the receiver or copy sheet, which is subjected to and adsorbs such a substantial amount of heat at high fusing temperatures, is likely to suffer from heat-related fusing and fixing defects such as curling, distortion, blistering and charring of such receiver or copy sheet.

SUMMARY OF THE INVENTION

It is therefore an object of the present invention to provide a fixing method and apparatus that substantially overcome the heat efficiency disadvantages of conventional fixing apparatus.

It is also an object of the present invention to provide a fixing method and apparatus in which the image-carrying receiver or copy sheet is not subjected to high fusing temperatures and heat, and therefore is not exposed to conditions likely to cause heat-related defects such as curling, distortion, blistering and charring thereof.

It is a further object of the present invention to provide a fixing method and apparatus that produce high quality fixed images.

In accordance with the present invention, a method for producing high quality fixed images in an electrostatographic copier or printer, includes (i) receiving unfused loose toner images from an image bearing member onto an intermediate fixing member, (ii) directly fusing the received loose toner images by means of a heat fusing unit, thereby forming fused toner images on such intermediate fixing member, and (iii) then transfer-fixing the fused images from the intermediate fixing member to a registered receiver or copy sheet of paper. Accordingly, the apparatus for such a method includes an intermediate fixing member for receiving the loose unfused toner images from the image bearing member, means for fusing such loose toner images to form fused toner images directly on the intermediate fixing member, and means for transfer-fixing the fused toner images from the intermediate fixing member to a suitable receiver or copy sheet of paper.

BRIEF DESCRIPTION OF THE DRAWINGS

In the description of the preferred embodiment of the present invention below, reference is made to the accompanying drawings, in which.

DESCRIPTION OF THE PREFERRED EMBODIMENT

Figure 1:
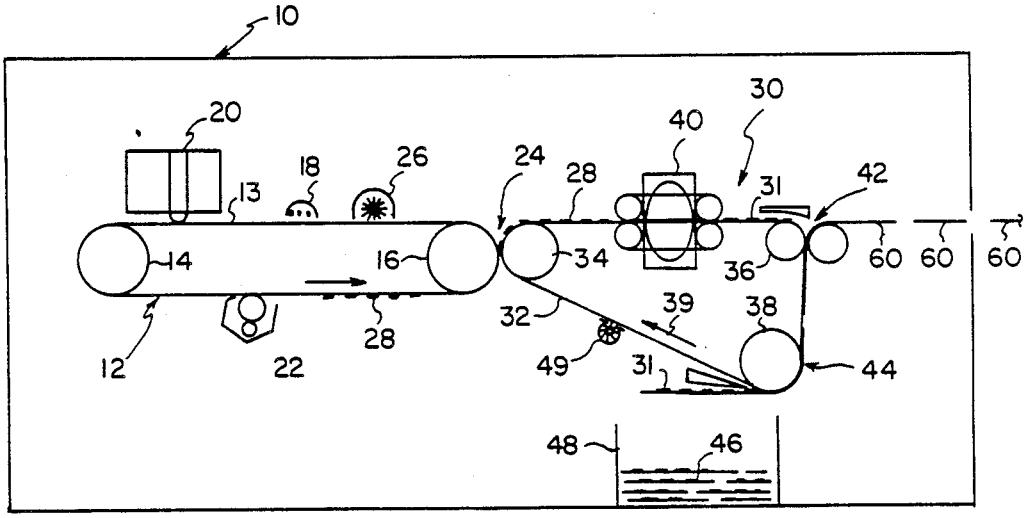
FIG. 1 is a schematic of an electrostatographic copier or printer including the fixing apparatus of the present invention.

Referring now to FIG. 1, an electrostatographic copier or printer 10 is shown including an image bearing member 12 that is trained, for example, about a pair of rollers 14, 16 for movement in the direction of arrow 17. Although the image bearing member 12 has been illustrated as a flexible web trained about a plurality of rollers, it is understood that it also can be a rotatable rigid drum. In either case, desired loose toner images can be formed on the member 12 by first electrostatically charging the surface 13 of member 12 using a charging device 18, and then imagewise exposing portions of the member 12, as for example, by means of imagewise light exposure or an electronic write head 20. The latent images so formed can then be made visible with loose toner particles 28 at a toner station 22.

FIG. 1 also illustrates the fixing apparatus of the present invention designated generally as 30. As shown, the imagewise pile of loose toner particles (images) 28, formed at the development station 22, are subsequently transferred, at a transfer station 24, to the apparatus 30 for subsequent fusing and fixing to a suitable receiver or copy sheet of paper 60. After such transfer at the station 24, the imaging member 12 is moved on and can be cleaned by a cleaning means 26, in preparation for similar use in forming, developing and transferring subsequent loose toner images.

As shown in FIG. 1, fixing apparatus 30 includes an intermediate fixing member 32 which is positioned to directly receive the loose toner images 28 from the surface 13 of the image bearing member 12. Intermediate fixing member 32 may come in the form of cut sheets or preferably as an endless flexible web that is trained about a plurality of rollers, for example, rollers 34, 62 and 38, for movement in the direction of arrow 39. As further shown, the apparatus 30 also includes (i) a heat fusing unit 40, such as an infrared unit, for directly fusing the imagewise pile of loose toner particles 28 thereby forming fused toner images 31 on the intermediate fixing member 32, (ii) means 42 for laminating and sandwiching the fused toner images 31 on the member 32 with a registered receiver or copy sheet of paper 60, and (iii) means 44 for causing the sandwiched fused images 31 to transfer from the intermediate fixing member 32, and to be fixed to the registered receiver or copy sheet of paper 60.

The receiver or copy sheet 60, with the fused images 31 fixed thereto, can thereafter be separated from the intermediate fixing member 32 for collection into a stack 46 in an output hopper 48. As shown, the member 32, after such separation, can be moved in the direction of arrow 39 where it can then be cleaned by cleaning means 49, in preparation for similar reuse.

Figure 2:
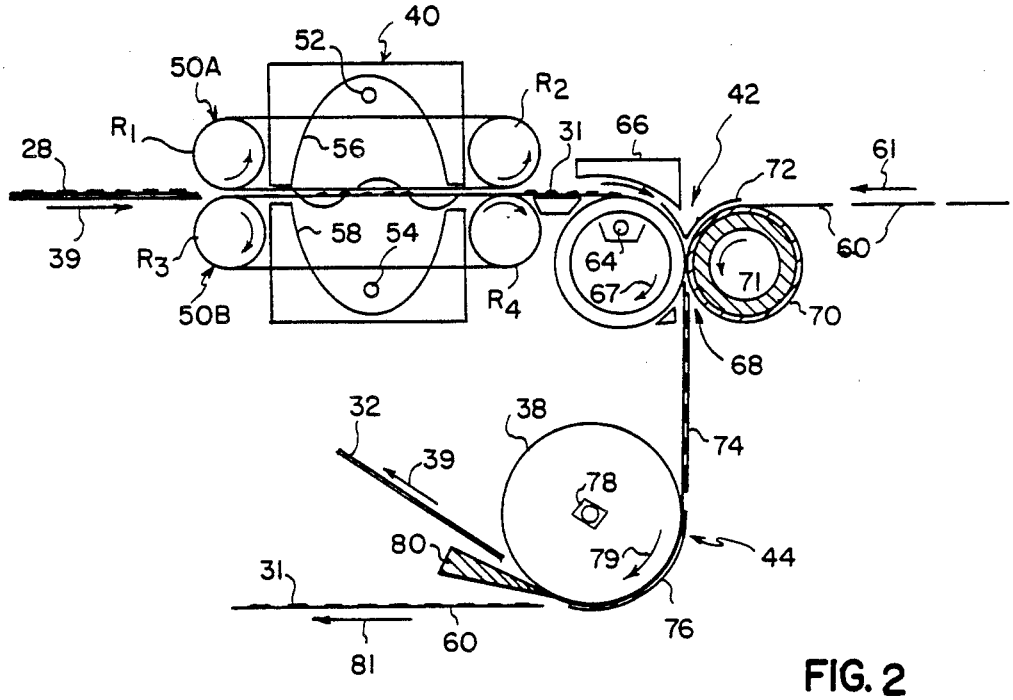
FIG. 2 is an enlarged schematic of the fixing apparatus of the present invention.

FIG. 2 illustrates the apparatus 30 in detail after it has received loose toner images 28, as above, from the image bearing member 12. The intermediate fixing member 32, whether as cut sheets or an endless web, should be made of a high temperature material such as KAPTON (a tradename of the Dupont Company). In addition, in order to substantially improve the heat efficiency of the apparatus 30, intermediate fixing member 32 should be transparent to infrared heat. As shown, the member 32 should be driven from its backside or by its edges, for example, by means of O-ring edge drive transports 50A and 50B (shown) in order to safely transport the loose toner images 28 thereon. A similar pair of transports (not shown) are also positioned and used on the far side opposite 50A and 50B. Such edge drive transports 50A and 50B (shown) which are trained and driven for example about rollers $R_1$, $R_2$ and $R_3$, $R_4$, make it possible to use the member 32 additionally in the form of cut sheets.

The apparatus 30 further includes the heat fusing unit 40 for heat fusing the imagewise pile of loose toner particles 28, (that is, the loose toner images 28) directly onto the intermediate fixing member 32. The unit 40 as shown may include the cut sheet edge drive transports 50A and 50B (shown), or other suitable transport means, for carrying the loose toner images 28 therethrough. Most importantly, the heat fusing unit 40 includes heat sources such as infrared heat lamps 52, 54, located one to the front or image side, and the other to the backside, of the member 32. Lamps 52, 54 should be capable of heating the pile of loose toner particles 28 to a desired fusing temperature setpoint sufficient to completely fuse or melt the pile of toner particles, thereby forming fused toner images 31 on the member 32.

Operatively, as the member 32 is being moved through the unit 40, lamp 52 heats the imagewise pile of toner particles 28 from the top or image side of the member 32, while lamp 54, located to the backside of the member 32, simultaneously and equally heats the same pile from the bottom, that is, from such backside of the member 32. Such backside heating is possible because of the fact that the member 32 is transparent to the infrared heat of lamp 54. When heated as such from the top and bottom, the pile of loose toner particles 28 completely, quickly and evenly fuses, that is, melts onto the member 32 and forms the fused toner images 31.

As a result of such heating, the actual fusing or melting of the pile of toner particles 28 is accomplished with less heat, and in less time. Additionally, the quality of the fused images 31, for example, the glossiness, is substantially improved over that achievable with conventional fusing apparatus. This is due particularly to the even flow (of the melting pile of toner particles 28) that results from the substantially equal top and bottom heating. Since no heat absorbing receiver or copy sheet of paper is used during such fusing within the unit 40, less heat is therefore required and/or utilized therein for accomplishing such complete and high quality fusing of the toner particles 28.

In order to improve its heat efficiency, the fusing unit 40 further includes elliptical heat reflectors 56, 58 for reflecting and refocusing heat from the lamps 52, 54 back onto the toner images 28 being fused.

After leaving the heat fusing unit 40, the fused images 31 on the member 32 are next transported to and through laminating means 42. At the means 42, the surface of the intermediate fixing member 32 carrying the fused images 31 is laminated with a suitable receiver or copy sheet of paper 60 that is fed by means (not shown) in the direction of arrow 61, and registered with the fused images 31. Such lamination results in a sandwiching of the fused images 31 between the portion of the member 32 carrying them and the registered receiver or copy sheet 60. As shown, the laminating means 42 includes a rigid roller 62 which is transparent to infrared heat, and which is kept warm, for example, by an infrared lamp 64. Lamp 64 should be capable of producing only sufficient heat to keep the fused images 31 in a warm and tacky condition. Such heat, of course, is much less than the heat produced by lamps 52, 54, for the actual fusing or melting of the toner particles 28. Within the means 42, the heat from the lamp 64 radiates through the transparent roller 62, through the transparent intermediate fixing member 32, and then into the fused images 31. A heat reflector 66, positioned to the front of the lamp 64 over the images 31, helps to reflect and preserve the heat from such lamp by concentrating the heat back onto such images 31. As shown, roller 62 is rotatable in the direction of arrow 67, and forms a pressure nip 68 with a rubber coated pressure roller 70. Roller 70 is in turn rotatable by suitable means (not shown) in the direction of arrow 71.

The receiver or copy sheet of paper 60, already registered to the images 31 by means (not shown), is moved simultaneously with the portion of the member 32 carrying the images 31, into a pressure nip 68, guided by guide plate 72. Within the nip 68, the registered receiver or copy sheet 60 is pressed over the images 31 against the member 32 thereby forming a laminate 74, and sandwiching the tacky fused images 31 therebetween.

The laminate 74 is next transported to and through the transfer or detack means 44, where aided by a guide and pressure plate 76, it is wrapped around a chilling and detack drum 38 such that the member 32 is in direct contact with the drum 38. Detack drum/roller 38 is chilled, for example, by cooling means 78, and is rotatable in the direction of arrow 79. The drum 38 is chilled or cooled as such as that when the laminate 74 is wrapped around it, as above, the side of the laminate consisting of the member 32 and contacting the drum 38 will become sufficiently cooler than the side consisting of the receiver or copy sheet 60.

Such uneven chilling or cooling of the laminate 74 against the detack drum 38, and under pressure from plate 76, causes the fused toner images 31 to transfer from the intermediate fixing member 32 and to be come permanently fixed to the receiver or copy sheet 60. As the drum 38 continues to rotate, the receiver or copy sheet 60 with the images 31 fixed thereto can be separated from the drum 38, for example, with the help of a skive device 80. The separated receiver or sheet 60 can then travel in the direction of arrow 81 for collection into the output hopper 48, and the intermediate fixing member 32 can be moved in the direction of arrow 39 where it can be cleaned in preparation for reuse.

Several advantages are achieved when loose toner images 28, formed by an electrostatographic copier or printer 10, are fixed to a suitable receiver or copy sheet 60 according to the method and apparatus 30 of the present invention. Firstly, the receiver or copy sheet 60 is not subjected to the high fusing temperatures and heat, for example, of heat lamps 52, 54, but is only remotely and indirectly subjected to the must less (warming) heat of lamp 64. Consequently, such receiver or copy sheet 60 is substantially free of heat-related fusing and fixing defects such as curling, distortion, blistering and charring thereof. Furthermore, the fused toner images and the final copy obtained on such receiver or sheet 60 possesses a high degree of gloss.

Secondly, because the intermediate fixing member 32 is transparent to infrared heat, and because the receiver or copy sheet 60 is not present in the fusing unit 40, substantially less heat is required by the apparatus 30 to completely fuse the imagewise pile of toner particles 28. As such, the apparatus 30 requires less heat and less time to heat fuse the particles 28, and therefore can be operated more efficiently and at higher speeds. Finally, heating the imagewise pile of toner particles 28 equally from the top and the bottom results in more even top and bottom flow of the pile during the ensuing fusing or melting, thereby adding substantially to the overall high quality of the final fixed images on the receiver or copy sheet.

Although the description of the invention has been made with particular reference to a preferred embodiment, it is understood that modifications and variations thereto can be effected within the scope and spirit of the invention.

What is claimed is:

1. In an electrostatographic copier or printer, in which loose toner images can be formed on an image bearing member, apparatus for fixing such loose toner images to a suitable receiver or copy sheet, the apparatus including:

(a) an intermediate fixing member for receiving the unfused loose toner images completely from the image bearing member;

(b) means for heating the received toner images to form completely fused toner images directly on said intermediate fixing member; and (c) means for transfer-fixing said fused toner images from said intermediate fixing member onto an unheated receiver or copy sheet, said means for transfer-fixing said fused images further including:

(i) means for sandwiching the fused images on said intermediate fixing member with a registered unheated receiver or copy sheet of paper; and (ii) transfer-fixing means for causing the sandwiched fused images to transfer from the intermediate fixing member and be fixed to the registered receiver or copy sheet of paper, said transfer-fixing means including a pressure plate and a chilling drum around which the sandwiched images are wrapped such that said intermediate fixing member is against said drum.

2. A method for producing high quality fixed images, on a receiver or copy sheet, in an electrostatographic copier or printer including means for forming unfused toner images on an image bearing member, the method including the steps of:

(a) transferring unfused toner images from the image bearing member directly to a fusing apparatus including an intermediate fixing member;

(b) heating the transferred unfused toner images on said intermediate fixing member to a desired high fusing temperature thereby completely fusing the toner images directly onto the intermediate fixing member; and (c) thereafter transferring and fixing said completely fused toner images from said intermediate fixing member onto an unheated receiver or copy sheet so as to avoid subjecting such receiver or copy sheet to high fusing temperatures of said heating step which are likely to cause heat-related fusing defects thereto, said transfer-fixing step further including the steps of:

(i) forming a laminate by press-laminating said intermediate fixing member with the suitable receiver or copy sheet, registered over and sandwiching said fused toner images thereon; and (ii) sufficiently chilling or cooling the intermediate fixing member side of said laminate wrapped around a chilling and detack drum under pressure, thereby causing a transfer and fixing of the fused images from the intermediate fixing member onto the suitable receiver or copy sheet.

* * * * *